US011566393B2

(12) United States Patent
Holtman

(10) Patent No.: US 11,566,393 B2
(45) Date of Patent: Jan. 31, 2023

(54) LAND ANCHOR

(71) Applicant: Keith Holtman, Bethel, OH (US)

(72) Inventor: Keith Holtman, Bethel, OH (US)

( * ) Notice: Subject to any disclaimer, the term of this patent is extended or adjusted under 35 U.S.C. 154(b) by 47 days.

(21) Appl. No.: 17/119,111

(22) Filed: Dec. 11, 2020

(65) Prior Publication Data

US 2021/0180278 A1 Jun. 17, 2021

Related U.S. Application Data

(60) Provisional application No. 62/946,636, filed on Dec. 11, 2019.

(51) Int. Cl.
*E02D 5/80* (2006.01)
*E02D 7/04* (2006.01)

(52) U.S. Cl.
CPC ..... *E02D 7/04* (2013.01); *E02D 5/80* (2013.01); *E02D 5/803* (2013.01)

(58) Field of Classification Search
CPC ..... E02D 5/80; E02D 5/803; B63B 21/24; B63B 21/243
USPC ..... 52/155, 156, 158, 159, 162, 163, 164, 52/165, 166; 114/294, 298, 301, 303, 114/304, 309
See application file for complete search history.

(56) References Cited

U.S. PATENT DOCUMENTS 1,051,334 A * 1/1913 Johnston ..... B63B 21/32 114/303
1,376,854 A * 5/1921 Bearse ..... E02D 5/803 52/155
1,459,768 A * 6/1923 Jackson ..... B63B 21/243 114/308
3,216,159 A 11/1965 Rooker
3,500,598 A 3/1970 Ettinger
3,888,057 A 6/1975 Zubke
3,961,451 A 6/1976 McCain
4,073,256 A * 2/1978 Rossini ..... B63B 21/44 114/304
4,644,894 A * 2/1987 Woodgate ..... B63B 21/44 114/304
4,704,982 A * 11/1987 Sahiberg ..... B63B 21/40 114/304
4,825,604 A 5/1989 Manning
5,437,128 A 8/1995 Gremillion
6,564,515 B1 5/2003 Fontenot et al.
6,735,911 B1 5/2004 Alexander
7,047,696 B2 5/2006 DiDomenico
(Continued)

*Primary Examiner* — Sunil Singh

(74) *Attorney, Agent, or Firm* — Ronald J. Richter; Nesbitt IP LLC

(57) ABSTRACT

A land anchor is disclosed for pulling an immobilized vehicle out of the mud or snow. The land anchor includes a pull bar which is reversibly connectable or linkable to a bucket by passing the pull bar through a slot in the bucket. The bucket portion of the anchor includes a blade which can be driven into the ground and then removed from the ground once the vehicle has been freed. A connecting end of the pull bar engages the bucket and prevents the pull bar from passing completely through the slot, and can include lateral wings for added strength. The land anchor can be positioned, anchored, and operated by a single person with assistance from a winch and cable assembly to move the immobilized vehicle to a solid area of ground.

8 Claims, 4 Drawing Sheets

(56) References Cited

U.S. PATENT DOCUMENTS

| | | | |
|---|---|---|---|
| 7,603,818 | B2 | 10/2009 | Guthrie |
| 7,624,545 | B2 | 12/2009 | Turley |

* cited by examiner

LAND ANCHOR

CROSS-REFERENCE TO RELATED APPLICATION

This application claims the benefit of U.S. Provisional Application No. 62/946,636, filed Dec. 11, 2019, the disclosure of which is hereby incorporated by reference in its entirety.

FIELD OF THE INVENTION

The present invention relates in general to land anchors and in particular to a portable land anchor for pulling an immobile vehicle out of the mud or snow.

BACKGROUND OF THE INVENTION

Off-road vehicles, farm equipment and lawn mowers often encounter mud, snow, or other traps in which the tires are unable to provide adequate traction to move the vehicle any further. Getting a tractor stuck in the mud in an open field can be a problem, and in remote areas in the United States it is possible to go days at a time without seeing other people, such that getting stuck while off-roading in these areas can be a big problem. A winch is a useful tool for freeing such trapped vehicles and is typically used to connect the vehicle by a cable, rope, or chain to any nearby stationary object such as a tree or fence post. A simple pulley action provided by the winch can shorten the length of the cable between the vehicle and the stationary object to free the vehicle from the mire. However, there may be times when there are no nearby stationary objects for the winch to attach to and pull against.

Land anchors have proven to be useful in freeing vehicles from the confines of snow, mud, sand, or other traps when there are no stationary objects in the vicinity. Various types of land anchors are known to help pull a vehicle which has lost traction to an area where it can gain traction and move on its own power. However, there remains a need for a land anchor that can be positioned, anchored, and operated by a single person, that can easily be driven into the ground, that is constructed to withstand the large forces necessary to extract immobilized vehicles from the mud or snow, that can be easily removed from the ground once the vehicle has been freed, and that is compact to require little cargo space when it is being stored in the vehicle.

Therefore, one objective of this invention is to provide an improved land anchor that can be positioned, anchored, and operated to move a vehicle to a desired area by a single person. Another objective of this invention is to provide an improved land anchor that can easily be driven into the ground and then easily removed from the ground once the vehicle has been freed. Still another objective of this invention is to provide an improved land anchor that is compact and portable.

SUMMARY OF THE INVENTION

Accordingly, the present invention provides a land anchor for use with a winch and cable assembly to extract an immobilized vehicle. The land anchor can be positioned, anchored, and operated by a single person to move the immobilized vehicle.

A preferred aspect of the invention is land anchor for extracting an immobilized vehicle, the land anchor comprising: (a) a bucket including a top wall having a slot, and an extending blade for penetrating the ground; and (b) a pull bar including a free end for passing through the slot in the bucket, and a connecting end for linking the pull bar to the bucket, wherein the free end includes a hole for attaching the pull bar to a winch cable mounted to the immobilized vehicle, and wherein the connecting end is adapted to engage the bucket during use and prevent the pull bar from passing completely through the slot.

The nature and advantages of the present invention will be more fully appreciated after reviewing the accompanying drawings, detailed description and claims.

BRIEF DESCRIPTION OF THE DRAWINGS

The accompanying drawings illustrate one or more preferred embodiments of the invention and together with a general description above and the detailed description below serve to explain the principles of the invention. The drawings and description herein are not intended to be exhaustive nor limiting of the invention.

DETAILED DESCRIPTION OF THE INVENTION

Figure 1A:
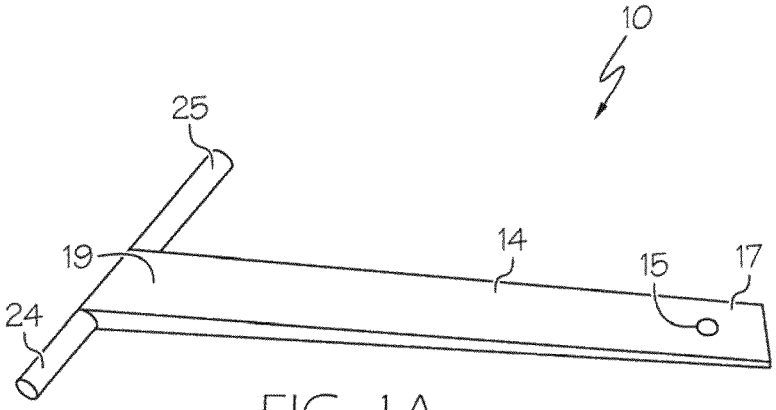
FIGS. 1A-1C illustrate a perspective view of a pull bar, a carabiner, and bucket of a land anchor according to the present invention.
Figure 1B:
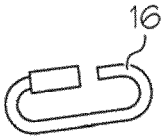
Figure 1C:
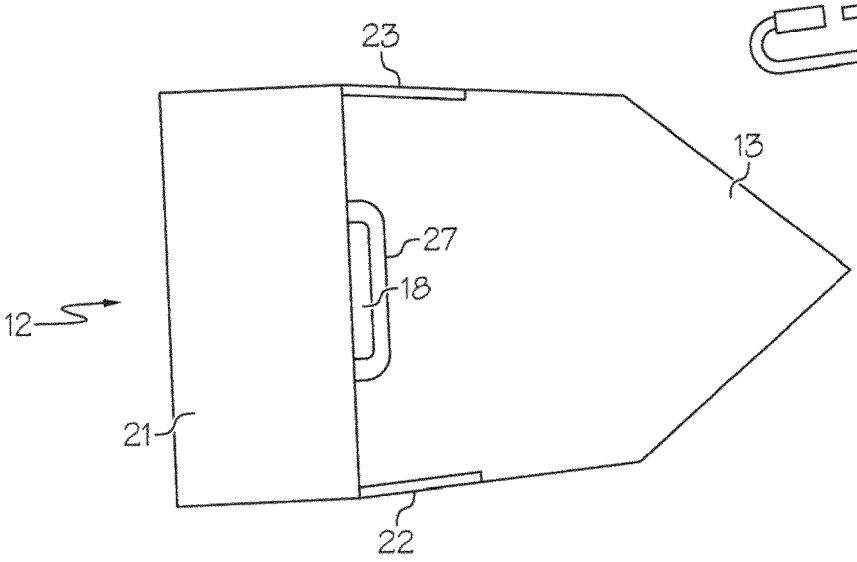
Figure 2:
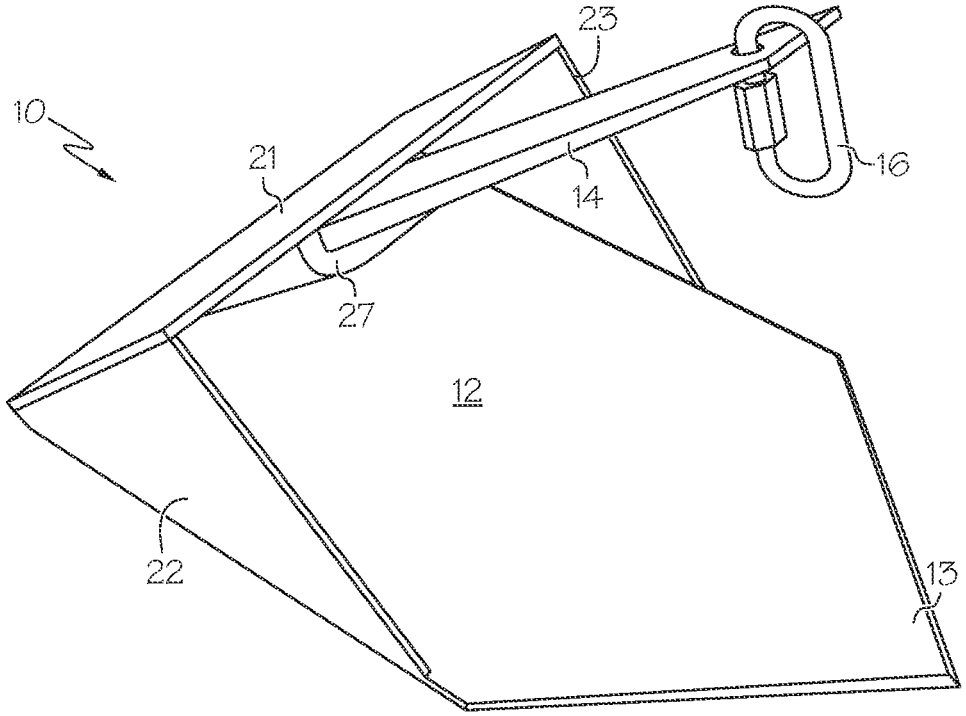
FIG. 2 is a perspective view of the pull bar, carabiner, and bucket of FIGS. 1A-1C linked together after assembly.
Figure 3:
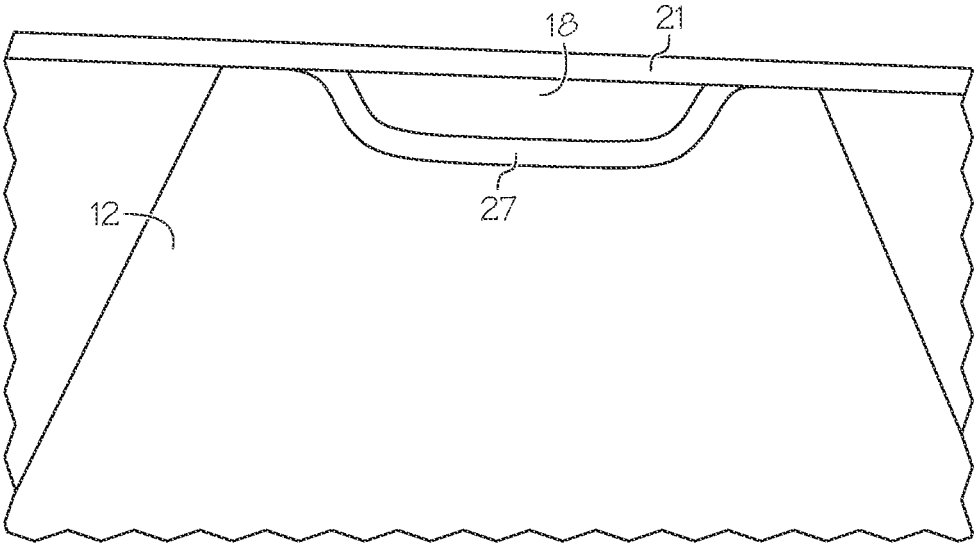
FIG. 3 is a close-up view of the elongated slot of the land anchor of FIG. 2.

Without any intent to limit the scope of this invention, reference is made to FIGS. 1-4 illustrating a preferred embodiment of the inventive land anchor 10 which can achieve each of the specific objectives set forth above, as well as other objectives that will become apparent from the ensuing detailed description. The inventive land anchor 10 generally comprises a bucket 12 and a shank or pull bar 14, which can be easily stored in a vehicle or a toolbox when not in use. The bucket 12 typically includes an extending anchor fluke or blade 13 and a top wall 21 having an elongated bore or slot 18. The slot 18 passes through the bucket 12 where the top wall 21 meets the blade 13 portion, and can be framed by an internal barrier or wall 27 welded or connected to the top wall 21 of the bucket (see FIGS. 3 and 4). Looking at the assembled anchor 10 in FIG. 2, note that the primary function of the bucket 12, and in particular its extending blade 13, is to penetrate the ground or soil to provide a stationary element towards which the immobilized vehicle can be pulled.

The pull bar 14 is reversibly connectable or linkable to the bucket 12 to form the land anchor. Specifically, the pull bar 14 can be wedge-shaped as illustrated, having one thick end designated herein as a connecting end 19 and tapering to a thin free end 17. To assemble the land anchor, the free end 17 of the pull bar is first passed through the elongated bore or slot 18 of the top wall 21 of the bucket. The slot 18 receives the free end 17 of the pull bar 14 at the juncture of the blade 13 and the top wall 21, and the pull bar is then pulled through the slot until end 19 is wedged into the slot 18 and cannot move any further.

Figure 4:
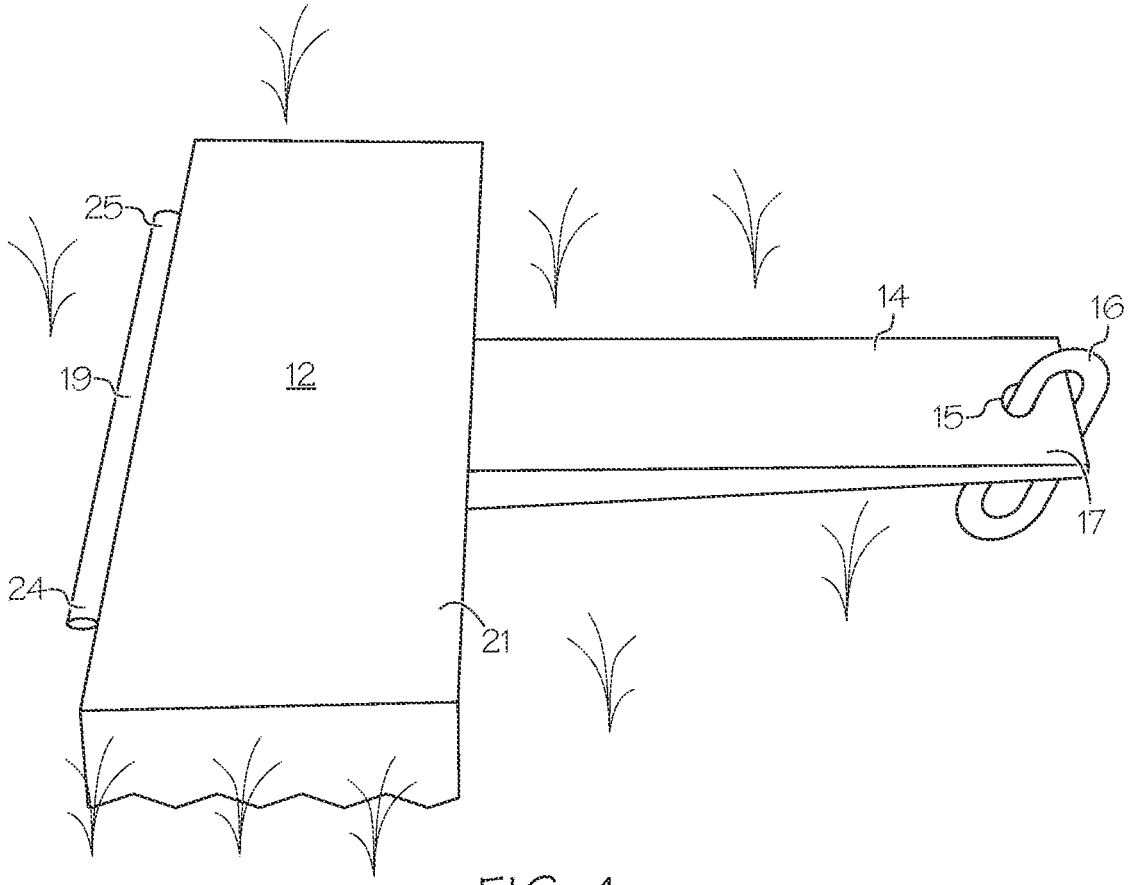
FIG. 4 is a perspective view of a buried land anchor as shown in FIG. 2.

The connecting end 19 of the pull bar can be in the shape of a T-shaped handle having lateral rods or wings 24, 25 which extend perpendicularly from the axis of the pull bar on each side of the connecting end 19. As seen in FIG. 4, having these lateral rods 24, 25 attached to the connecting end 19 can be useful for providing added strength to the linkage of the pull bar 14 with the bucket 12, aiding the wedged connection of the pull bar with the slot in preventing the end 19 from being pulled completely through the bucket 12. The use of this T-shaped pull bar 14 can be advantageous when anchoring a particularly heavy load.

The top wall 21 of the bucket is manufactured to be (assembled, made, constructed, built) at an acute angle with the blade 13. In a preferred embodiment, after the pull bar 14 is positioned through the slot in the top wall 21, the pull bar 14 is at an angle of about 45 degrees with the blade 13. At this angle, a user can push or otherwise drive the blade 13 into the ground a few inches initially, and then use the winch to pull the blade deeper into the ground. As can be appreciated from viewing FIG. 4, the angle between the top wall 21 (including slot 18) and the blade 13 is intended to allow the top wall 21 and the pull bar 14 to extend generally flat to the ground surface once the blade 13 has satisfactorily penetrated the soil, thus providing consistent and efficient anchoring. Once the blade is fully buried into the ground, the top wall 21 and the pull bar 14 are maintained substantially parallel to the ground surface. If the ground is anticipated to be wet, muddy, or soggy, the bucket can also include a pair of side walls 22, 23 to help prevent loose soil from passing through or around the bucket, thus providing further resistance and pulling force.

The free end 17 of the pull bar 14 also includes a hole 15 for attaching to the end of a winch cable mounted to the immobilized vehicle. The hole 15 can be circular as shown, as well as oblong or elliptical in shape, and can also be useful for connecting a quick link or carabiner 16 once the free end 17 has been passed through the slot 18 (see FIG. 2). The carabiner 16 in turn can attach to the end of the winch cable and the combination can be used to extract the vehicle.

As noted above the pull bar can be attached to a winch cable, which is attached to the front end of the immobilized vehicle. Once the immobilized vehicle is attached, the pull bar determines the direction of the pulling force created by the winching operation. During the winching process the blade 13 of the bucket is forced into the ground until the resistance of further blade penetration is greater than the force necessary to move the vehicle. At this point the vehicle can then be pulled towards the land anchor 10 via the winch. After vehicle extraction, if the bucket 12 has been driven too deeply into the ground to be removed by hand, the vehicle and winch can be used to pull the bucket from the ground. In between uses the inventive land anchor, which is intended to be compact and portable, can be placed in a storage position by resting the pull bar within the bucket.

The pull bar can be between about eight inches and twelve inches long from free end 17 to connecting end 19. As a non-limiting example, the connecting end 19 of the wedge-shaped pull bar 14 can be about a third of an inch thick, tapering to about a quarter of an inch thick at the free end 17; as such, the internal diameter or height of the slot 18 in the top wall 21 of the bucket would have to be less than a third of an inch and more than a quarter of an inch, so that the free end 17 of the pull bar would be able to pass through the slot, but not the connecting end 19. The bucket 12 including the blade 13, the top wall 21, the internal wall 27 and the side walls 22, 23 can be between an eighth of an inch and a quarter of an inch thick, and made of steel or of any other material having a similar strength. The bucket 12 can be about twelve inches tall from the free end of the top wall 21 to the blade 13 and about eight inches wide. The lateral wings 24, 25 can each be up to about two inches long and between about a quarter of an inch and three eights of an inch thick.

While the present invention is described above in considerable detail, such detail is not intended to restrict or limit the scope of the appended claims. Additional advantages and modifications will be readily apparent to those skilled in the art without departing from the concept or scope of the invention.

What is claimed is:

1. A land anchor for extracting an immobilized vehicle, the land anchor comprising:
- a) a bucket including:
  - i) a top wall, the top wall including an internal wall connected thereto, and a slot framed by the internal wall; and
  - ii) an extending blade for penetrating the ground, wherein the top wall is manufactured at an acute angle with the blade; and
- b) a wedge-shaped pull bar including:
  - i) a tapered free end for passing through the slot in the bucket, wherein the slot receives the free end of the pull bar at the juncture of the top wall and the extending blade and wherein the free end includes a hole for attaching to a winch cable mounted to the immobilized vehicle; and
  - ii) a thick connecting end for reversibly linking the pull bar to the bucket, wherein the pull bar is pulled through the slot so that the connecting end becomes wedged within the slot.

2. The land anchor of claim 1, the bucket further including two side walls for preventing soil from passing through the bucket.

3. The land anchor of claim 1, wherein the acute angle is 45 degrees.

4. The land anchor of claim 1, wherein a carabiner is connected to the hole for attaching to the winch cable.

5. The land anchor of claim 1, wherein the connecting end of the pull bar includes a pair of lateral wings for aiding in preventing the pull bar from passing completely through the slot.

6. The land anchor of claim 1, wherein the pull bar is between about eight inches and twelve inches long from the free end to the connecting end, and wherein the connecting end is about a third of an inch thick, the free end is about a quarter of an inch thick, and the height of the slot is less than a third of an inch and more than a quarter of an inch.

7. The land anchor of claim 1, wherein the blade, the top wall, and the internal wall are between an eighth of an inch and a quarter of an inch thick.

8. A land anchor for extracting an immobilized vehicle, the land anchor comprising:
- a) a bucket, the bucket including the combination of:
  - i) a top wall, the top wall including:
    - 1) an internal wall connected to the top wall; and
    - 2) a slot framed by the internal wall;
  - ii) an extending blade for penetrating the ground, wherein the top wall is manufactured at an acute angle with the blade;
  - iii) side walls for preventing soil from passing through the bucket; and
- b) a wedge-shaped pull bar including:
  - i) a tapered free end for passing through the slot, wherein the slot receives the free end of the pull bar at the juncture of the top wall and the extending blade; and ii) a thick connecting end for reversibly linking the pull bar to the bucket, wherein the pull bar is pulled through the slot so that the connecting end becomes wedged within the slot.

* * * * *